US006503151B2

(12) United States Patent
Kosovac

(10) Patent No.: US 6,503,151 B2
(45) Date of Patent: Jan. 7, 2003

(54) GOLF CLUB

(75) Inventor: Milana Kosovac, New York, NY (US)

(73) Assignee: Chapel Golf, Inc., North Palm Beach, FL (US)

( * ) Notice: Subject to any disclaimer, the term of this patent is extended or adjusted under 35 U.S.C. 154(b) by 0 days.

(21) Appl. No.: 09/812,513

(22) Filed: Mar. 20, 2001

(65) Prior Publication Data

US 2001/0029209 A1 Oct. 11, 2001

Related U.S. Application Data

(60) Provisional application No. 60/191,799, filed on Mar. 24, 2000.

(51) Int. Cl.[7] ..... A63B 69/36; A63B 53/02; A63B 53/04

(52) U.S. Cl. ..... 473/244; 473/251; 473/312; 473/313; 473/341; 473/349

(58) Field of Search ..... 473/288, 324, 473/330, 340, 341, 349, 333, 334, 251, 305, 246, 244, 248, 308, 309, 310, 311, 313, 314, 342, 312

(56) References Cited

U.S. PATENT DOCUMENTS

| | | | | |
|---|---|---|---|---|
| 1,319,802 | A | * | 10/1919 | Shea |
| 3,042,405 | A | | 7/1962 | Solheim |
| 3,220,733 | A | | 11/1965 | Saleeby |
| 3,387,844 | A | | 6/1968 | Shippee |
| 3,516,674 | A | | 6/1970 | Scarborough |
| 4,063,733 | A | * | 12/1977 | Benedict |
| 4,113,249 | A | | 9/1978 | Beery |
| 4,162,074 | A | * | 7/1979 | Thomson |
| 4,444,395 | A | | 4/1984 | Reiss |
| 4,912,830 | A | | 4/1990 | Vesligaj |
| 4,915,385 | A | * | 4/1990 | Anderson |
| 4,979,744 | A | * | 12/1990 | Alcala |
| 5,090,698 | A | | 2/1992 | Kleinfelter |
| 5,127,653 | A | * | 7/1992 | Nelson |
| 5,277,866 | A | * | 1/1994 | Wright |
| 5,308,067 | A | * | 5/1994 | Cook |
| 5,382,019 | A | * | 1/1995 | Sneed |
| 5,388,827 | A | * | 2/1995 | Reynolds |
| 5,501,461 | A | * | 3/1996 | Donofrio |
| 5,536,011 | A | | 7/1996 | Gutowski |
| 5,797,176 | A | * | 8/1998 | Rose |
| 5,842,935 | A | | 12/1998 | Nelson |
| 5,938,543 | A | | 8/1999 | McGeeney et al. |
| 6,095,931 | A | | 8/2000 | Hettinger et al. |
| 6,328,662 | B1 | * | 12/2001 | Huang |

FOREIGN PATENT DOCUMENTS

| | | | |
|---|---|---|---|
| EP | 0 965 366 A1 | | 12/1999 |
| TW | 362523 | * | 12/1998 |
| WO | WO 01110513 A1 | | 2/2001 |

* cited by examiner

*Primary Examiner*—Sebastiano Passaniti
(74) *Attorney, Agent, or Firm*—Leydig, Voit & Mayer, Ltd.

(57) ABSTRACT

A golf club having superior balance and sensory feedback which includes a shaft connected to a clubhead comprising two basic elements, an integrated hosel and body portion of relatively low mass and specific gravity which defines a striking surface and a distal toe portion and a heel portion of relatively high mass and specific gravity uniquely integrated with the combined hosel and body portion. In preferred embodiments the clubhead has a cylindrical striking surface, polar mass concentrations for optimum dynamic performance and a combination of unique sighting and alignment features which co-operate to provide optimum sensory perception and feedback. A body portion with a shaped striking surface surrounding a target point and a top surface with an identifying indicium is integrally formed with a hosel extending from the top surface of the body portion with a flat alignment surface configured to cooperate with the indium and thus enhance a golfer's alignment and stroking of the ball, thus providing resultant confidence and consistency.

29 Claims, 4 Drawing Sheets

GOLF CLUB

CROSS-REFERENCE TO RELATED PATENT APPLICATIONS

This patent application claims priority to U.S. Provisional Patent Application No. 60/191,799, filed Mar. 24, 2000.

TECHNICAL FIELD OF THE INVENTION

The present invention relates to the field of golf clubs, and more particularly, to the field of golf putters.

BACKGROUND OF THE INVENTION

The prior art has provided numerous golf clubs, and particularly, golf putters, that are designed to improve the performance of the golfer or otherwise enhance the golfing experience. For example, U.S. Pat. No. 3,042,405 to Karsten Solheim discloses a golf club having internal weights at the heel and toe ends of the club with two thin plates connecting them. U.S. Pat. No. 4,444,395 to Morton Reiss shows a golf putter having an elongated head. The head includes a low mass center section with a length at least 1½ times as long as the ball diameter and two more massive end sections. The sections have substantially the same transverse cross section forming a single continuous cylinder. A major portion of the mass is in the end portions which may be connected together longitudinally through the center section by two steel pins. The club shaft is secured to the head centrally in the center section. More recently, U.S. Pat. No. 5,090,698, issued to Thomas A. Kleinfelter, discloses a golf putter having a circular-cylinder clubhead with a striking face suspended between two flanges near the toe and heel respectively. This is said to provide a center of percussion extending along essentially the entire length of the clubhead to thereby provide an optimum strike against the ball even if the ball contact is off center. Another approach to putter shape, size and weight distribution is found in U.S. Pat. No. 5,938,543 to McGeeney et al. where a center section of the head is of relatively low mass density material and has a longitudinal dimension greater than one and one-half ball diameters. The head has higher density metallic heel and toe portions with an integrally formed hosel extending upwardly from the heel portion. The heel, center and toe portions extend depthwise from a striking surface to a back surface with a substantially uniform depthwise construction.

Numerous other golf clubs have been provided in the prior art described by the designers as enhancements of sound, balance, or human factor considerations.

Some golf clubs known in the art are said to have an awkward "feel" when striking a golf ball, believed to be in part because of the distribution of weight within the clubhead. In addition, while the prior art has provided other golf clubs that are said to have a proper feel and to be properly balanced, many of these golf clubs are unattractive and the physical appearance is distractive. Those configurations do not provide the optimum perspective to the golfer as the ball is addressed or audible response as the club strikes the ball. There thus exists a need in the art for a golf club that has an optimum feel, an appearance which supports concentration and a sighting perspective and audible response that optimize the relationship between golfer and putter. It is a general object of the invention to provide a club that satisfies the foregoing criteria.

Specifically, the general objects of the invention include the creation of a golf club, especially a putter, that provides sensual feed-back to the golfer for improved performance.

The golfer, golf club and golf ball are connected during the swing and at impact to provide superior sensitivity to the action, a dynamic sense of balance and an enhanced "feel" which is fed back visually and by tactile sensations indicative of stroke quality. This is augmented by visual features whereby enhanced "sighting" is provided. The improved characteristics are believed to result from the shaft and a central body section with a uniquely configured striking surface that are integrated through a connective means. The function of the unique body/shaft configuration is augmented by the other structural and facial features of the invention as described and claimed.

SUMMARY OF THE INVENTION

The present invention provides a well-balanced golf club that satisfies the foregoing general objects. The golf club of the invention includes a shaft that has a handle end and a clubhead end. Means connects the clubhead end to a clubhead comprising two basic elements. The two basic clubhead elements are (1) a body portion defining a striking surface integrally related to an aligning surface, to a sighting surface and to the shaft and handle through connection means, and (2) polar weighting including a relatively massive distal toe portion and a similarly massive heel portion secured to the body at the toe end and heel end respectively. In a preferred embodiment, the body portion is secured between the heel and toe portions configured for optimum dynamic balance, inertial stability, sensitive golfer feedback and related enhanced sighting. The body portion, shaft and connecting means are preferably of low mass density materials compared to the heel portion and toe portion to provide an optimum polar mass distribution. In one preferred embodiment, the toe portion and the heel portion are connected together through an integrally cast medial portion to form a shell by preliminary casting whereby the body is subsequently formed in the shell by a second casting step. This structure and procedure are disclosed in detail in International Patent Publication No. WO 01/10513, which is incorporated in its entirety in this application by reference.

By having the connecting means strategically located on the body, close to the heel portion and of the same low density material as the body and shaft, optimum weight distribution advantages are obtained. The body portion is visible as a flat top surface which assists the golfer in addressing the ball and aligning the club and ball for the putt. The configuration of the connecting means that may be a hosel includes a flat alignment surface which has a synergistic relationship to the body shape and has body/shaft interaction through the connection means.

In preferred embodiments of the invention, the clubhead body portion has a striking surface having a cylindrical surface configuration and preferably a cylindrical configuration the longitudinal axis of which is aligned with the longitudinal axis of the clubhead. The striking surface extends between the top surface and a bottom surface forming a portion of the sole of the club. The striking surface is defined by a central segment of a circle centered on the intended hitting spot that correlates with the sweet spot or center of gravity and the top and bottom surfaces. It is a portion of the striking face of the clubhead.

In a preferred embodiment, the combined shaft and body portion and the connecting means includes a reinforcing armature connecting the shaft and body portion, and the body portion is a generally rectilinear blade having an exposed striking surface, a sole surface, a sighting top surface and a rearward sole back shelf. The back configuration of the toe and heel portions may conform to the body. In another preferred embodiment the rear of the body portion is cut-away to define a rear sole shelf to further augment the polar mass distribution while the toe and heel portions are not cut away, thus provided augmented polar mass. However, the invention provides advantages in blade-type putters with or without a cut-away back and in mallet-type putters having various back configurations. The connecting means preferably includes a double offset portion to provide an upper portion aligned with the shaft axis and with the striking surface.

Other features and objects of the invention will be apparent from the following description of the invention.

DESCRIPTION OF THE DRAWINGS

For clarity, the following nomenclature, adapted from the prior art, will be employed in the description. The ball striking surface or 'strike face' of the clubhead, which is intended to hit the golf ball, is located on the 'front' of the clubhead. The terms 'top' and 'bottom' assume that the clubhead is oriented as it would be if the golf club were held by a golfer in an at rest position, i.e., the bottom of the clubhead, also called the sole, would contact the ground when at rest. The heel of the clubhead is located longitudinally opposite the toe of the clubhead. The heel portion of the clubhead would be nearest the golfer when the golfer holds the club in an at rest position. The term "depth" refers to a dimension extending from the front to the back of the golf club. The terms "length" of the clubhead and "longitudinal" refer to a dimension extending from the heel end to the toe end.

DESCRIPTION OF THE INVENTION

Figure 1:
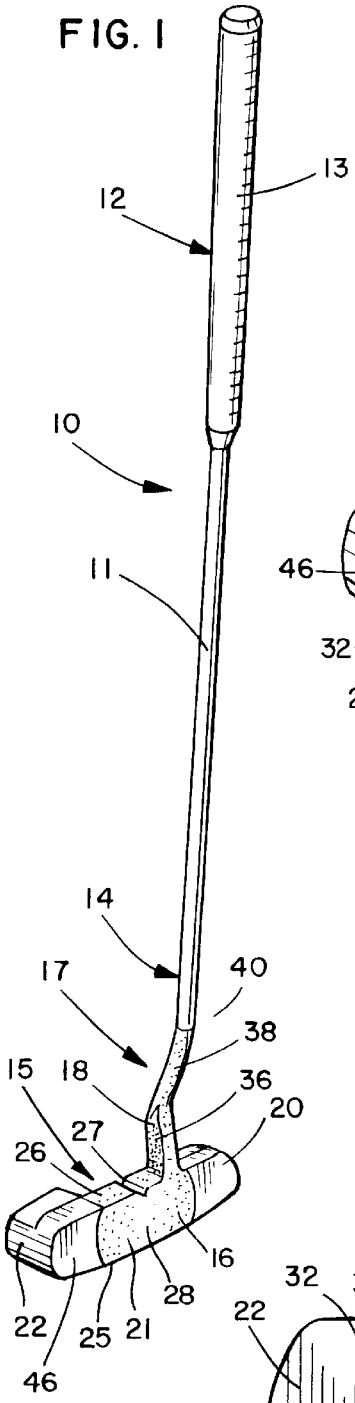
FIG. 1 is an overview perspective of one embodiment of the invention.

The invention provides a golf club which may constitute any one of a set of golf clubs designed for the game of golf including, for example, a driver, a fairway "wood" or "iron" or other club. Preferably, however, the golf club of the invention is in the form of a putter and is thus designed to facilitate controlled golfer action in striking a golf ball on a relatively smooth, slightly yielding, playing surface to cause the golf ball to roll toward its intended target. The club is to impart a slight positive loft to the ball. With reference to FIG. 1, the golf club 10 has a clubshaft 11 which may be fabricated from graphite, a metal such as tubular steel or other conventional materials. In the preferred embodiment the shaft is made of graphite material or a fiberglass reinforced resin. At the golfer gripping end 12 of shaft 11, an overlying grip 13 is provided which may be leather or a synthetic cover, and may have any conventional surface treatment and authorized shape. Opposite the gripping end 12, the shaft 11 has a clubhead end 14 which is mounted to a clubhead 15 by a connecting means such as hosel 17.

The clubhead 15 comprises two basic components, a central body portion 21 and polar masses including a heel portion 20 and a toe portion 22 (end portions). A connecting means such as hosel 17 includes a central portion 38 that provides an offset whereby the shaft 11 is aligned with a striking surface 28. The connecting means may be an integrally formed portion of the body 21 as illustrated by hosel 17 in FIGS. 1–3. The connecting means may also be formed integrally with the shaft 11 and the body 21 in a single casting operation. The casting may be in graphite, a fiber filled resin or other appropriate low mass density material.

Figure 2:
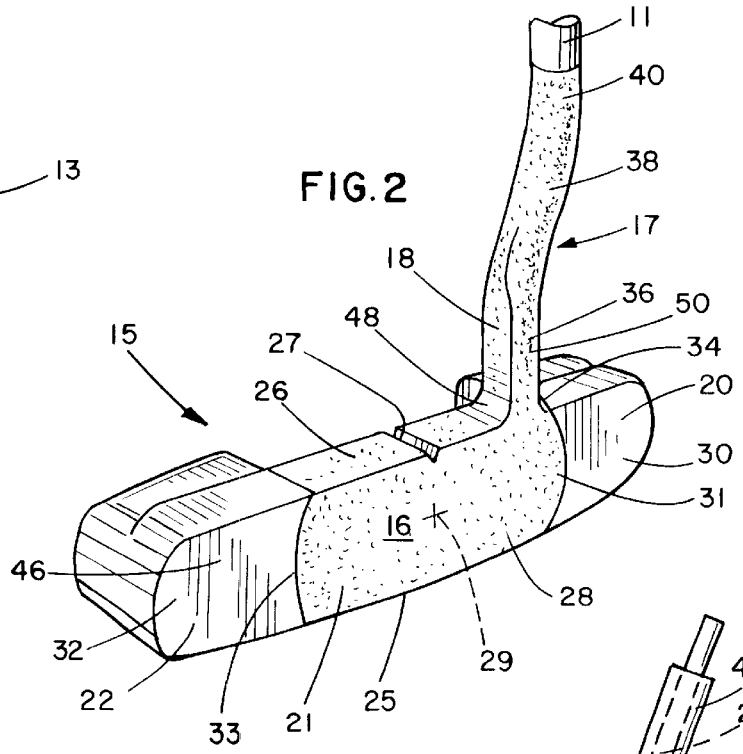
FIG. 2 is a perspective view of the clubhead of the embodiment of the invention shown in FIG. 1.
Figure 3:
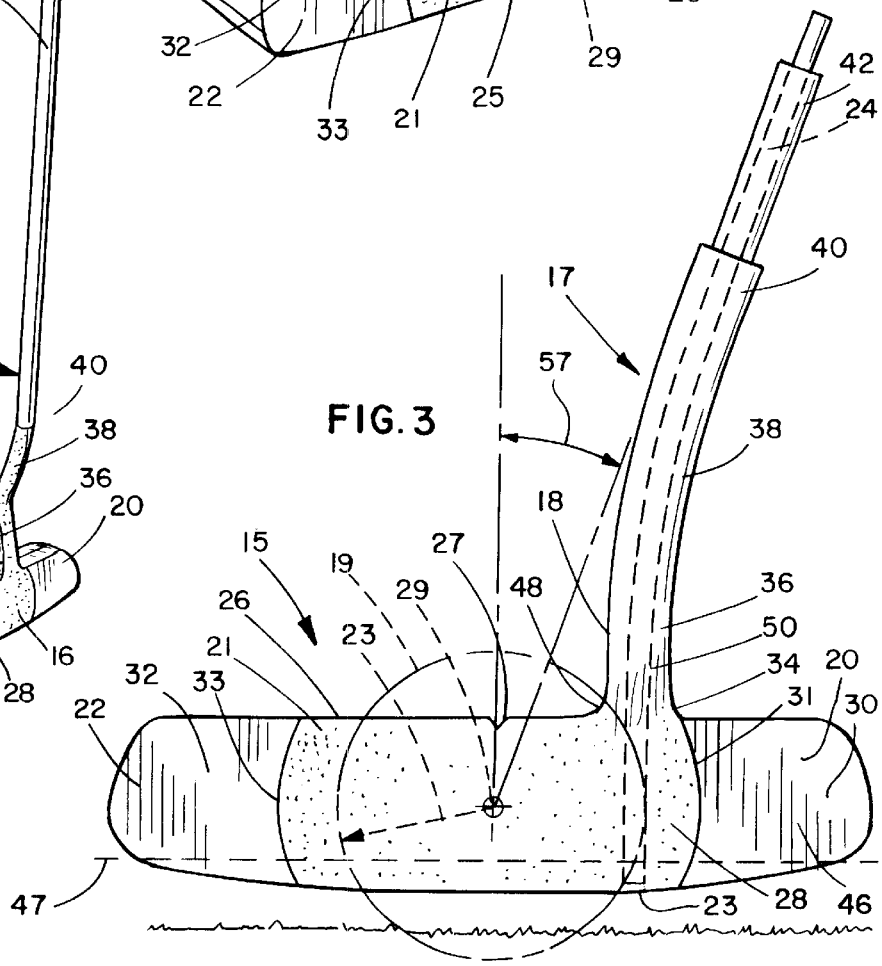
FIG. 3 is a front elevation of the clubhead of FIG. 2 when in a putting position.

The casting may also comprise only the connecting means 17 and body 21, as shown in FIGS. 1–3, or only the connecting means 17 and shaft 11. The connecting means 17 may also be cast separately as a hosel and integrated with the shaft 11 and body 21 as by a fusion process or cementation adequate to provide physical integrity and aesthetic appeal. As shown in FIGS. 3 and 8–10, in a preferred embodiment when the hosel 17 is integrally cast with the body portion 21 to form a body/hosel 16, a reinforcing armature 24 integrates the two elements as described further hereinafter. If the hosel 17 is cast separately, it is integrated with the body 21 by armature 24. In such a construction an aperture is provided in the body 21 to receive the lower end 36 of the hosel and the armature 24 (see FIG. 10). The hosel and body are appropriately cemented within the aperture.

The body portion 21 has a flat top surface 26 extending between similar top surfaces on end portions 20, 22. The top surface has a back edge generally parallel with a striking surface 28, and, in preferred embodiments the top elongate surface is narrower than the total depth of the club. There is a central point on the striking surface, identified in the Figures with cross-hairs 29, which is related to the center of gravity of the clubhead and the so-called "sweet-spot." In the embodiment of FIGS. 2, 3 and 10, the body portion 21 has a cylindrical-type striking surface 28 which conforms to a similar cylindrical-type striking surface 30 on heel portion 20 and a striking surface 32 on the toe portion 22. The striking surfaces 28, 30 and 32 align to define a clubhead striking face 46. In the preferred embodiment, the striking face 46 comprises a segment of a right circular cylinder, the directrix 47 of which aligns with but is below and behind the longitudinal axis of the clubhead through the hit spot 29 (seen best in FIG. 3). In one preferred embodiment, that directrix is slightly below the longitudinal central axis of the clubhead, and the radius for the cylinder is 4.6 inches. Thereby, when the clubhead strikes a golf ball with an optimum stroke, it imparts a slight positive loft to the ball. In one standard configuration the tangent to the striking surface at the central longitudinal axis through cross-hairs 29 forms an angle of about 4° to the vertical, called the loft angle.

In the preferred embodiment an indicia is formed in the top surface 26 to assist the golfer in alignment and stroking. As shown in the drawings, the indicia is a straight groove 27, normal to the striking surface 28 and aligned with the sweet spot 29. The flat top surface 26 extends upwardly in the form of a flat surface 18 on hosel 17. It has been found that the hosel flat surface 18 and the flat top surface 26 co-operate to provide a unique visual perception for the golfer. The indicia 27 on the top surface 26 aligned with the sweet spot 29 further enhances the alignment capability of the relatively narrow flat surfaces 26 and 18. In one preferred embodiment the indicia 27 is formed as a transverse groove, either in the process of casting or molding the body 21, or with an appropriate tool in a post-casting cutting operation.

The totality of the alignment system also includes coordination of the striking surface 28 with the flat surfaces 26 and 18 and indicia 27. The striking surface 28 has upper and lower longitudinal edges conforming to top surface 26 and sole 25. The heel edge 31 and toe edge 33 are segments of a circle extending between the upper and lower edges. The radius 23 of the circle that determines the heel and toe edges of the striking surface is greater than the radius of a golf ball but less than 1.5 times the radius of a golf ball. One standard golf ball has a diameter of 1.68 inches. In one preferred embodiment, the radius 23 is 1.25 inch.

As shown best in FIG. 3, the center for the heel edge 31 and toe edge 33 is shown as cross-hairs 29 and a golf ball 19 is shown in broken lines centered on the crosshairs 29. As previously mentioned, the cross-hairs 29 locate what is perceived to be the optimum point of impact with the ball, related to the center of gravity, center of momentum and the so-called "sweet spot."

The impact point at 29 is at about the midpoint between sole surface 25 and top surface 26. The height of the striking surface 28 is preferably in the range of about 0.8 inch to about 1.2 inch.

Figure 8:
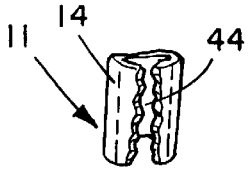
FIG. 8 is a perspective view of the embodiment of FIG. 2 showing the striking face thereof and details of one embodiment of the body with a fragment of the shaft and the connecting means.
Figure 8:
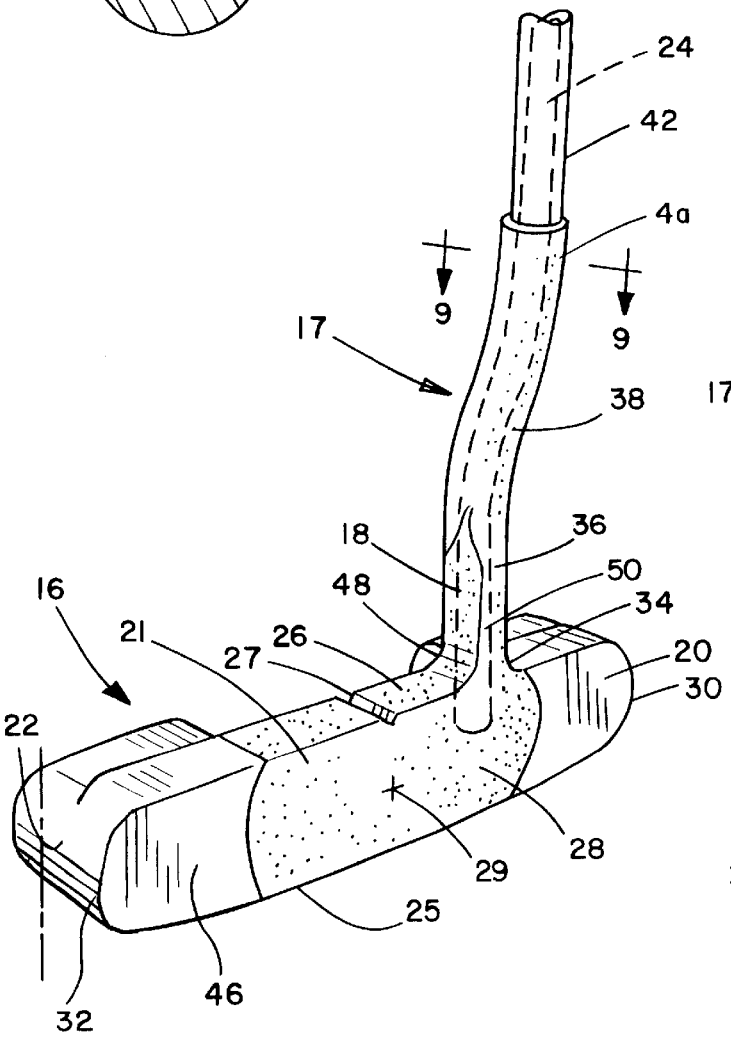

The body 21 is shown in FIG. 3 cast as an integral non-metallic unit with hosel 17 surrounding armature 24. The armature 24 strengthens and integrates the body portion 21 and hosel 17. As shown in FIG. 8, a reduced diameter portion 42 of hosel 17 is configured to receive a hollow cylindrical portion 44 of the clubhead end 14 of the shaft 11. The outer diameter of the clubhead end 14 of shaft 11 is substantially the same as the outer diameter of the upper shaft portion 40 of hosel 17. The shaft and hosel are sealed in an aligned abutting relationship. In embodiments where the shaft 11 and connecting means 17 are cast simultaneously, that part will include the armature 24 as shown in FIGS. 3 and 8 and the integrally formed connecting means 17 and shaft 11 may appear to be and actually be seamless.

In embodiments with the hosel 17 formed as a separate connecting means, the body 21 has a generally vertical aperture extending from the top surface 26 to a location above the sole 25 and having a cross-section to closely receive an extension (shown as broken lines 35 in FIG. 10) of the hosel 17.

Figure 4:
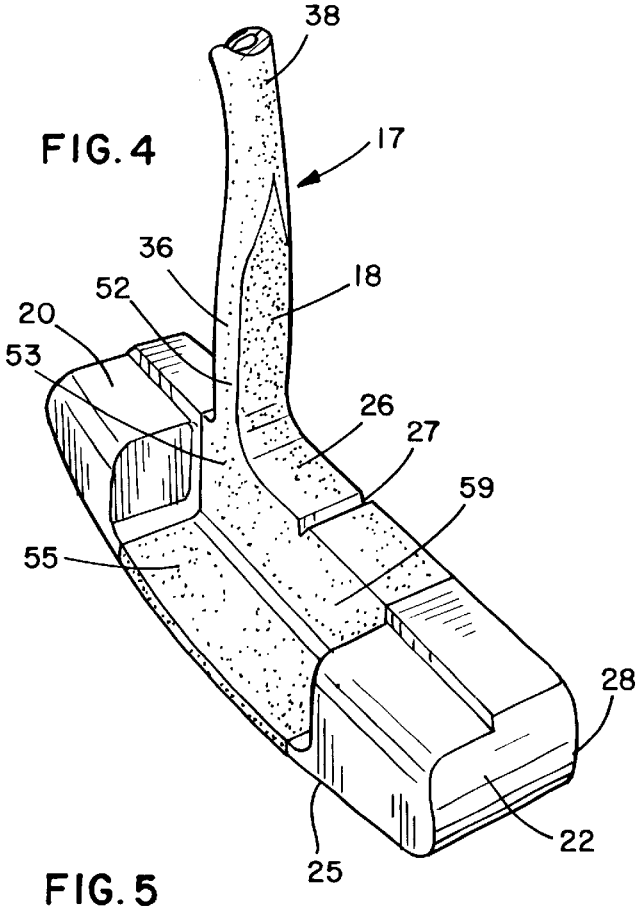
FIG. 4 is a perspective view of the clubhead of FIG. 2 showing the top and backside thereof.

A fairing 34 blends the clubhead portion 36 of hosel 17 to the heel portion 20 while, in the preferred embodiment, a gradual curved surface 48 joins the flat surface 18 on the body side of the hosel clubhead portion 36 with the top surface 26 of the body 21. The flat surfaces 18, 26 and 48 provide an aesthetic as well as visually advantageous pattern to the golfer for sighting as the club addresses the ball. As shown in FIG. 2, the front side of the clubhead end 36 of hosel 17 has a flattened surface 50 which joins and blends with the striking surface 28 of body portion 21. Similarly, as shown in FIG. 4, the straight portion 36 of hosel 17 has a flattened surface 52 which joins and blends with the rear surface 53 of the body portion 21 above a sole shelf 55. Shelf 55 extends rearwardly from the upright portion 59 of the body 21.

As discussed above, a preferred embodiment of the invention shown in the Figures employs a clubhead of the cutaway blade type. In this embodiment the body portion 21 is cut away as best shown in FIGS. 2 and 4 to provide the upright striking section 59 and a horizontal shelf section 55 which extends to the rear edge of the head between the toe portion 22 and heel portion 20. The shelf 55 cooperates with the toe and heel portions to define the rear section of the sole 25.

Figure 10:
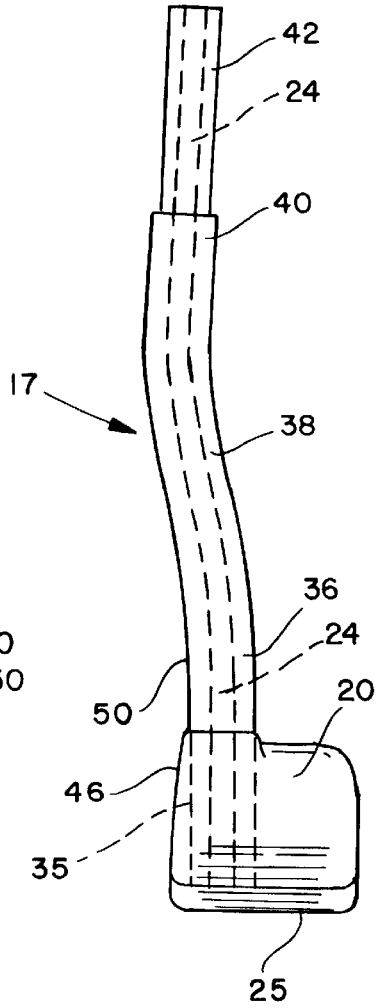
FIG. 10 is a heel-end elevation view of the embodiment of FIG. 9.
Figure 11:
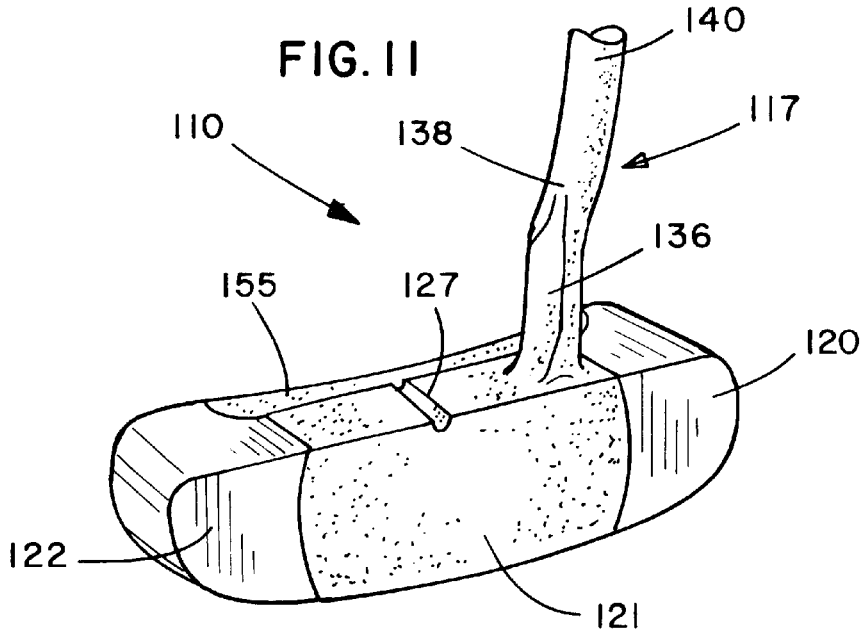
FIG. 11 is a perspective fragmentary view of another embodiment of the invention in the mallet configuration.
Figure 12:
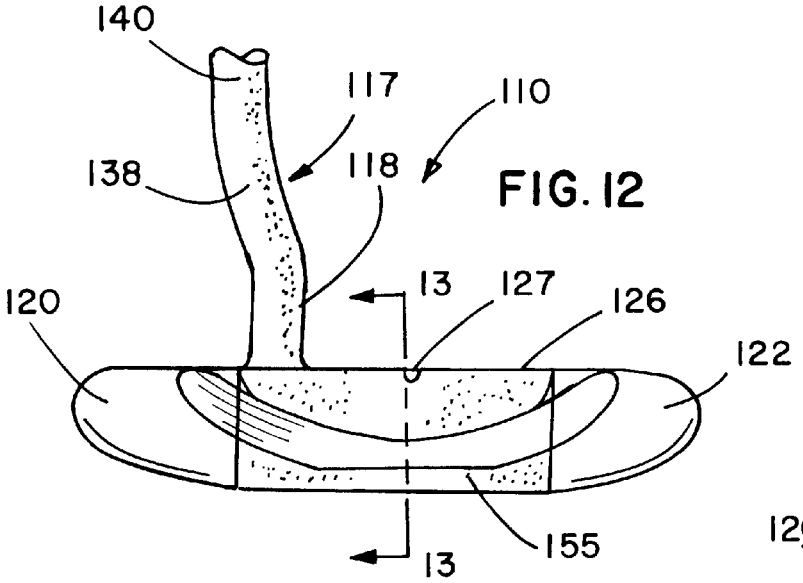
FIG. 12 is a rear fragmentary elevation of the embodiment of FIG. 11.
Figure 13:
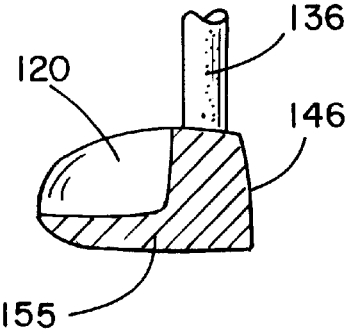
FIG. 13 is a sectional view taken on the line 13—13 of FIG. 12.

A putter 110 constructed according to the invention and of the mallet type is shown in FIGS. 11–13. The body 121, connecting means 117 with the offset portion 138, the heel end portion 120 and toe end portion 122 conform to the teaching with respect to FIGS. 1–10. The high mass heel end portion 120 and toe end portion 122 will have interfaces as exemplified in FIGS. 5–7 and will comprise inserts in the mold when the body 121 is cast.

The connecting means 117 may be simultaneously cast with the body 121 to form an integral part or cast separately and appropriately integrated by fusion or cementation, as already described above. Similarly, the shaft, extending upwardly from the shaft portion 140 of the connecting means, may be cast in graphite or other materials of similar specific gravity and physical characteristics simultaneously with the body 121 and connecting means 117. Such procedures and embodiments have already been described above.

The incorporation of an armature in these embodiments, whether the parts are cast simultaneously or not, is believed to provide worthwhile improvement in strength, reliability and structural integrity. Moreover, the sighting indicia 127, flat hosel face 118 and other features described above are advantageously incorporated in the mallet-type putter 110. As best seen in FIG. 13, the rearwardly extending sole shelf 155 is significantly extended beyond that shown in FIGS. 1–10. Similarly, the toe end 122 and heel end 120 have a more bulbous and massive appearance and feel preferred by many golfers. The mallet-type putter, when configured according to this disclosure, accomplishes the advantages set forth above. The striking face has the loft and configuration described above to provide the sighting and dynamic benefits as well as the aesthetic appeal already described.

Referring to FIGS. 2 and 3 showing the clubhead configuration, the connecting means or hosel 17 is shown extending upwardly in clubhead section 36 with a curved intermediate section 38 and a straight shaft end 40. The angle at which the shaft end 40 of hosel 17 engages and supports the shaft 11 is selected for optimum golfer comfort and accuracy. The angle 57 of the shaft 11 and shaft end 40 of the connecting means 17 is preferably about 71° relative to the vertical and is sometimes referred to as the lie angle. In the preferred embodiment, the lie angle is correlated with the position of the connecting means on the body portion and the length of the shaft so that the golfer's line of sight along the toe edge of the shaft and hosel portion 40 generally passes close to the hitting spot as identified in FIG. 3 with cross hairs 29.

In addition to forming the lie angle 57, the central offset portion 38 of hosel 17 also defines a forward offset of the shaft axis relative to the striking surface. This determines the alignment of the shaft and consequently the golfer's line of sight relative to the striking face 46 as best shown in FIG. 10.

The golf club of the invention may be fabricated of various materials employing various processing steps and manufacturing techniques. In the preferred embodiment the body 21 as well as the shaft 11 and connecting means 17 are fabricated of a graphite reinforced urethane. The heel portion 20 and toe portion 22 of the head are preferably of metal, and preferably high density metal such as alloys e.g., stainless steel. The heel and toe portions in preferred embodiments do not have the rearward section cut away to match the body upright section 59 and shelf 55. This optimizes the polar weight distribution wherein 75–90 percent of the mass is in the end portions.

Figure 6:
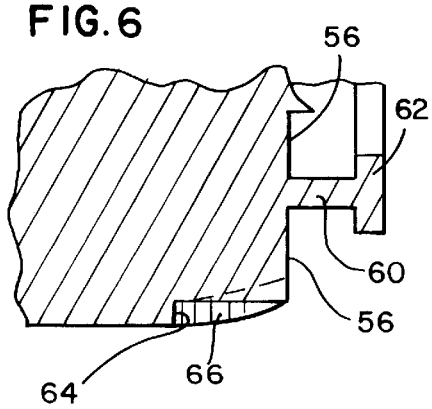
FIG. 6 is a fragmentary view taken on the line 6—6 of FIG. 5 further illustrating the interface thereof.

The preferred sequence for the manufacture of the golf club described herein is to cast the high mass heel portion 20 and toe portion 22 as separate component parts and in a subsequent operation employ those two component parts as inserts in an appropriate mold which defines the shape and nature of the body 21 disposed therebetween as well as the shaft 11 and connecting means 17. Two preferred configurations for the heel portion and toe portion are shown in FIGS. 5–7 which enhance the structural integrity of the ultimate product.

Figure 5:
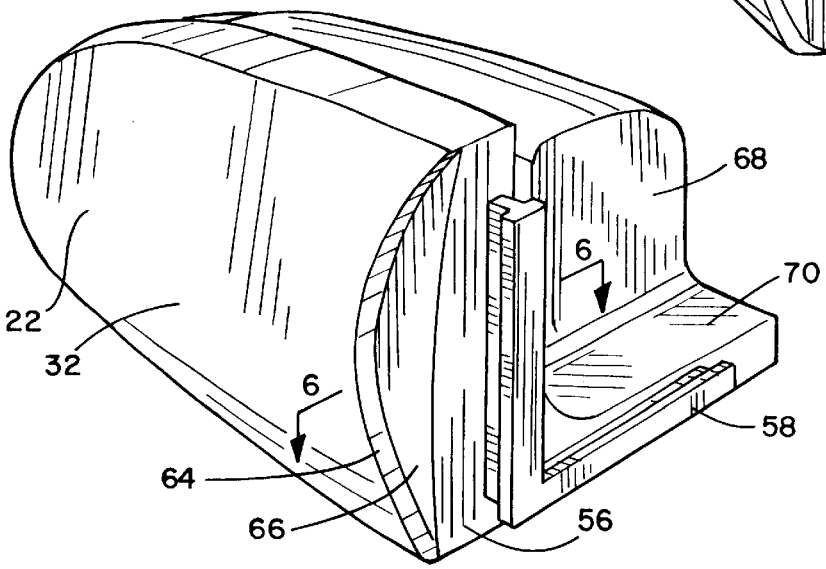
FIG. 5 is a perspective view of the toe portion of the clubhead of FIG. 2 showing one interface configuration.
Figure 9:
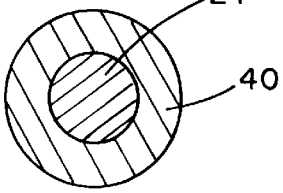
FIG. 9 is a cross-sectional view taken on the line 9—9 of FIG. 8.

FIG. 5 shows a toe portion 22 which can be employed as an insert in a casting operation. The interface of insert 22 with the body 21 to be formed includes a flat interface surface 56 which has a T-shaped tie or key 58 integrally formed therewith. This key rigidly, permanently and immovably secures the insert 22 to the body 21 after casting as shown in FIGS. 1–4. The key 58 includes a base 60 with a cross key 62 extending from the face 56 shown best in FIG. 6. The insert 22 in FIG. 5 has the striking surface 32 with the cylindrical shape already described above. That striking surface 32 is cut away along the arc 64 to define a cavity between the recessed insert surface 66 and a congruent portion of the mold for the body 21, not shown. Thus, while the insert interface 56 can be a flat surface, the cavity defined by surface 66 and the mold will form an arcuate extension of the body as identified by the arc 33 in FIG. 3. The back side of the insert has a transverse exposed vertical face 68 and a shelf surface 70. The shelf joins with the shelf 55 of body 21 and is sealed thereto. The mold for body 21 will define the surface of the body shelf 55 in alignment with the surface 70 of the insert. This configuration with the facia defined by surfaces 64 and 66 further enhance the polar mass distribution.

Figure 7:
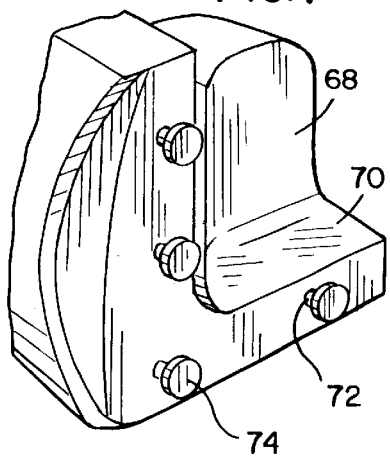
FIG. 7 is a perspective view of a clubhead toe fragment configured as shown in FIG. 2 showing an alternative interface.

An alternate interface for the heel and toe portions 20 and 22 is shown in FIG. 7. There, rather than the T-shaped key to lock the body and toe together, a set of pins 72 with heads 74 provide adequate locking of the inserts in the body that is cast therebetween. In all other respects the heel and toe portions of FIGS. 5 and 7 are the same.

While the material used to form the body, shaft and connecting means has been described as graphite fiber reinforced urethane, the material used may be selected from a group of materials having the strength and rigidity characteristics required for this application which might include styrene copolymers, copolyesters and polyurethanes. These may incorporate inorganic fillers. Similarly, while a stainless steel alloy is preferred for the high mass toe and heel portions, it is relatively expensive. Various materials having the proper mass densities could be employed and formed by appropriate processes.

While various embodiments of the invention have been described and incorporate various elements of the invention in different optimum combinations, the overall objectives of the invention and the specific enhancements described with respect to certain embodiments are all parts of the invention. It is contemplated that the invention may be implemented in such various combinations all of which are intended to be encompassed within the scope of the following claims.

What is claimed is:

1. A golf club comprising:

a shaft having a player gripping end and a clubhead end; and a clubhead extending from said shaft at said clubhead end, said clubhead having a heel, a toe, a sole, a top and a striking face therebetween, said clubhead including:

an elongate body portion having a toe end, a heel end, an upper surface extending longitudinally between said ends and a striking surface having a target location at about the midpoint between the toe end and the heel end and between said top surface and said sole, said striking surface forming a portion of said striking face extending downwardly from said top surface and a means extending upwardly from a location on said top surface and connecting said body portion and the clubhead end of said shaft, said body portion and said means being formed of non-metallic material as a single piece;

a distal toe portion extending outwardly from the toe end of said body portion;

a heel portion extending outwardly from the heel end of said body portion, the material and shape of said toe portion and said heel portion being selected to provide mass concentration at the heel and the toe of said clubhead.

2. The golf club of claim 1 wherein said body portion and said means are formed of a graphite composite.

3. The golf club of claim 1 wherein said body portion, said shaft and said means are formed of a generally homogenous composite as a single body portion/shaft component.

4. The golf club of claim 1 wherein said means comprises a hosel connected to said clubhead end and to said body portion.

5. The golf club of claim 4 wherein said body portion upper surface extends to and is a part of said top and said body portion has a bottom surface underlying said hosel and forming a part of said sole.

6. The golf club of claim 1 wherein said toe portion and said heel portion are formed of relatively high mass specific gravity material and said body portion is formed of a generally homogeneous, relatively low mass specific gravity non-metallic material formed therebetween with its toe and heel ends sealed to said toe portion and said heel portion, respectively.

7. The golf club of claim 1 wherein said toe portion and heel portion are secured to said body portion and form seals therewith.

8. The golf club of claim 1 wherein said upper surface is aligned with said striking surface, visible to a player gripping said player gripping end of said shaft and oriented to the shaft as a sighting aid.

9. The golf club of claim 1 wherein said toe portion and heel portion have surfaces transverse to said striking surface and sealingly engaged by said toe end and heel end of said body portion.

10. The golf club of claim 9 wherein said toe portion and heel portion surfaces have projections toward each other which are enclosed and entrapped by the body portion material formed therearound.

11. The golf club of claim 1 wherein said body portion includes an upright portion defining said striking face and said upper surface and a bottom portion extending transversely from said striking surface to define a central portion of said sole.

12. The golf club of claim 1 wherein said heel end and said toe end of said striking surface define arcs of a circle with said target centrally located.

13. The golf club of claim 1 wherein said means has a flat surface extending upwardly from said upper surface facing said toe end and perpendicular to said striking surface to constitute an aligning aid.

14. The golf club of claim 13 wherein said upper surface has aligning indicium above said target.

15. The golf club of claim 1 wherein said combined body portion and means includes a relatively rigid internal armature extending between said connecting means and said body portion.

16. A golf club comprising:

a shaft having a player gripping end and a clubhead end; and a clubhead extending from said shaft at said clubhead end, said clubhead having a heel, a toe, a sole, a top and a striking face therebetween, said clubhead including:

an elongate body portion having a toe end, a heel end, an upper surface extending longitudinally between said ends and a striking surface having a target location along a longitudinal axis at about the midpoint between the toe end and the heel and between said top surface and said sole and forming a portion of said striking face extending downwardly from said top surface, and connecting means extending upwardly from a location on said top surface intermediate said heel end and said target and connecting said body portion and the clubhead end of said shaft, said body portion and said means being formed of non-metallic material as a single piece;

a distal toe portion extending outwardly from the toe end of said body portion; and a heel portion extending outwardly from the heel end of said body portion, the material and shape of said heel portion and said toe portion being selected to provide mass concentration at the heel end and the toe end of said clubhead.

17. The golf club of claim 16 wherein the combined body portion and connecting means is formed of a graphite composite.

18. The golf club of claim 16 wherein said combined body portion and connecting means is formed of a generally homogenous composite including glass fibers and a resin.

19. The golf club of claim 16 including connecting means establishing a lie angle between said longitudinal axis and said shaft.

20. The golf club of claim 16 wherein the upper surface has an aligning indicium above said target to assist the golfer in aligning the clubhead and the ball.

21. The golf club of claim 20 wherein said indicium defines a straight line perpendicular to said striking surface.

22. The golf club of claim 16 wherein said striking face is a segment of a longitudinal cylindrical surface having a curved cross section to provide loft.

23. A golf club comprising:

a shaft having a player gripping end and a clubhead end; and a clubhead extending from said shaft at said clubhead end, said clubhead having a heel, a toe, a sole, a top and a striking face therebetween, said clubhead including:

an elongate body portion and a hosel combined with said shaft and an armature therebetween, said body portion having a toe end, a heel end, an upper surface extending along a longitudinal axis between said ends and a striking surface having a target location at about the midpoint between the toe end and the heel end and between said top surface and said sole and forming a portion of said striking face extending downwardly from said top surface, said hosel extending upwardly from a location on said top surface intermediate said heel end and said target location, and said armature interconnecting said body portion, hosel and shaft;

a distal toe portion extending outwardly from the toe end of said body portion; and a heel portion extending outwardly from the heel end of said body portion, the material and shape of said heel portion and said toe portion being selected to provide mass concentration at the heel end and at the toe end of said clubhead.

24. The golf club of claim 23 wherein said combined body portion hosel and shaft is formed integrally surrounding said armature.

25. The golf club of claim 24 wherein said combined body portion and hosel is formed of a generally homogeneous non-metallic material.

26. A golf club comprising:

a shaft having a player gripping end and a clubhead end; and a clubhead extending from said shaft at said clubhead end, said clubhead having a heel, a toe, a sole, a top and a striking face therebetween, said clubhead including:

a combined elongate body portion, hosel and armature, said body portion having a toe end, a heel end, an upper surface extending longitudinally between said ends and a striking surface having a target location at about the midpoint between the toe end and the heel and between said top surface and said sole and forming a portion of said striking face extending downwardly from said top surface, said hosel extending upwardly from a location on said top surface intermediate said heel end and said target and connecting the clubhead end of said shaft and said body portion, said hosel having an intermediate offset portion to generally align said shaft with said striking surface;

a distal toe portion extending outwardly from the toe end of said body portion; and a heel portion extending outwardly from the heel end of said body portion, the material and shape of said heel portion and said toe portion being selected to provide mass concentration at the heel end and the toe end of said clubhead.

27. The golf club of claim 26 wherein said offset portion extends transversely to said striking face and said shaft.

28. The golf club of claim 27 wherein said offset portion forms a small acute angle relative to said shaft.

29. The golf club of claim 26 wherein said offset portion extends transversely relative to said striking face and provides a large obtuse angle between said shaft and said longitudinal axis to define a lie angle.

* * * * *